United States Patent [19]

Kunzelman

[11] 4,316,703

[45] Feb. 23, 1982

[54] GAS COMPRESSOR

[76] Inventor: Richard D. Kunzelman, 3627 Garnet #24, Torrance, Calif. 90503

[21] Appl. No.: 89,529

[22] Filed: Oct. 29, 1979

[51] Int. Cl.[3] ..... F04F 11/00

[52] U.S. Cl. ..... 417/66; 415/92; 417/85; 417/103

[58] Field of Search ..... 417/66, 85, 100, 103; 415/5, 6, 92; 414/220; 137/392, 441, 434

[56] References Cited

U.S. PATENT DOCUMENTS

| | | | |
|---|---|---|---|
| 1,054,710 | 3/1913 | Olson | 60/639 X |
| 1,343,577 | 6/1920 | Okey | 60/675 X |
| 1,346,898 | 7/1920 | Kingsbury | 137/392 |
| 1,768,279 | 6/1930 | Wood | 417/66 |
| 2,492,460 | 12/1949 | Botelho | 414/220 |
| 2,808,156 | 10/1957 | Messing et al. | 414/220 |
| 3,352,108 | 11/1967 | Eddy | 60/675 X |
| 3,479,801 | 11/1969 | Yamasaki | 415/6 X |
| 3,941,030 | 3/1976 | Massung | 60/675 X |
| 3,983,704 | 10/1976 | McFarland | 60/675 X |

*Primary Examiner*—William L. Freeh
*Assistant Examiner*—Edward Look
*Attorney, Agent, or Firm*—John Holtrichter, Jr.

[57] ABSTRACT

The specification discloses a gas compressor incorporating a rotating wheel with cavities therein, the cavities transferring gas into a chamber of elevated pressure while simultaneously using the cavities to transfer a liquid out of that chamber.

18 Claims, 5 Drawing Figures

GAS COMPRESSOR

BACKGROUND OF THE INVENTION

The background of the invention will be set forth in two parts.

Field of the Invention

This invention relates to gas compressors and more particularly to such compressors utilizing a rotating element.

Description of the Prior Art

Probably the most well-known type of gas compressor uses a reciprocating piston moving in a cylinder and in which some type of valving is used to allow low pressure gas to enter the cylinder at the bottom of a piston stroke, and to allow compressed gas to leave the cylinder at or near the top of the piston stroke.

Another technique which has been developed to compress a gas utilizes one or more rotors and no valves. A typical example of this type compressor is the Wankel compressor which consists of two rotors, one inside the other, both located within a common stationary outer casing. The outer rotor has an epitrochoidal inner surface which provides a working interface with the inner rotor. The inner rotor is shaped like a triangle with curved sides, and with a port in each face, located midway between the rotors apices. With a good seal arrangement, this type of compressor has good efficiency and is virtually vibrationless. A good description of compressor and internal combustion engines utilizing a rotor to provide compression may be obtained by referring to many texts written on the subject of Wankel engines, such as for example, the book by Jan P. Norbye, first published in 1972 by Clinton Book Company, New York.

Although other devices have been developed to advantageously utilize certain characteristics of rotating liquid or gas carrying pockets or troughs, none utilize a wheel carrying cavity structure to compress a gas. For example, in U.S. Pat. No. 3,941,030 to P. Massung, a motor is activated by a combination of fluid pressure, such as air, and gravity. The motor comprises a rotor, a shaft which carries a cylindrical shell that is divided into an even number of cells. Each cell contains an elastomeric bag which communicates, through a transverse passage in the shaft, with a bag of a diametrically opposite cell. Each connected pair of bags contain a supply of Mercury, sufficient to fill one bag. A rotary valve, carried by a shaft outboard of the shaft bearings, controls admission and release of fluid pressure to and from the cells in the cylindrical shell via longitudinal passages in the shaft. This action sequentially supplies fluid pressure to the cells in order to expel the liquid from the bags in the lower cells to bags in the upper cells, thereby producing a torque on the rotor due to gravity acting on the Mercury in the upper cells.

Another such device having carriers disposed about the periphery of a wheel is described in U.S. Pat. No. 1,054,710 to C. Olson. Here, a water motor is shown to have a casing with upper and lower compartments defined by a central horizontal division wall. A first water wheel with buckets is mounted on a rotatable shaft in the lower compartment, which shaft is coupled by a belt to a second rotatable shaft on which a second water wheel with buckets is mounted in the upper chamber. Falling water is directed on the buckets of the upper wheel to cause it to rotate, and the water leaving the buckets falls into the upper chamber where it flows through a pipe and is ejected under pressure through the nozzles onto the buckets of the lower wheel and causing it to rotate at high speed.

Still another example of a device incorporating a wheel having cups or deflectors is the turbine wheel as seen in U.S. Pat. No. 1,343,577 to P. Okey. This patent concerns a heat engine which produces mechanical work by utilizing the heat contained in the atmosphere as a primary source of energy. The system includes a lower boiler communicating at its upper portion, through a conduit and a nozzle, to the upper portion of a hermetically sealed housing in which is located a shaft-mounted turbine wheel, the housing being located above a condenser which is surrounded by a wicking kept wet by a water supply in a cup. The lower portion of the condenser in turn communicates with the bottom portion of boiler through an insulated conduit. The system is first evacuated and a working fluid is then introduced into the system through a valve at the top of the boiler. Water evaporation from the wicking causes the temperature in the condenser to lower and condense working fluid vapor which then flows down into the boiler. This action creates a partial vacuum in the condenser and forces working fluid from the boiler to flow up the conduit and out of the nozzle and onto the blades of the turbine wheel to rotate a shaft and its work-output pulley.

Also possibly pertinent to the present gas compressor invention, as may subsequently evident, is an atmospheric pressure plant described in U.S. Pat. No. 3,352,108 to J. J. Eddy. The device has an upper vacuum tank connected by a vertical intake pipe and a directional valve to a lower water reservoir. Steam from a boiler is introduced into the tank and air and water are driven out of the tank through an outward pipe and a valve into a chamber to create a vacuum in the tank. This elevated water is then discharged through the outward pipe into the chamber and then through a run-off pipe, passed a turbine unit, and finally falls back to the water reservoir.

Further, the inventor is aware of a solar operated thermodynamic device described in U.S. Pat. No. 3,983,704 to L. C. McFarland. The drive converts solar energy to mechanical energy by causing a volatile liquid located in a primary chamber to move up a vertical standpipe and to activate a hydraulic motor while on its way to an elevated tank and chamber that drains into a reservoir.

It will be noted from the foregoing description of the prior art that although devices are known that include cavity or blade-carrying wheels, and housings having multiple chambers with some communication between the chambers, none show singularly or in combination with others a technique of using a cavity carrying wheel communicating between two separate chambers to transfer a gas into one chamber from the other while simultaneously moving a liquid in the opposite direction, as does the invention to be described in detail hereinafter.

SUMMARY OF THE INVENTION

In view of the foregoing factors and conditions characteristic of the prior art, it is a primary object of the present invention to provide a new and improved gas compressor.

Another object of the present invention is to provide an efficient and relatively economical-to-operate gas compressor.

Still another object of the present invention is to provide a gas compressor in which cavities in a wheel are used to simultaneously transfer a gas into a chamber of elevated pressure and a liquid out of that chamber.

Yet another object of the present invention is to provide a large capacity gas compressor which includes torque-reducing structure to improve efficiency.

In accordance with an embodiment of the present invention, a gas compressor includes a housing with first and second chambers separated by a wall structure. A wheel with cavities therein is rotatably mounted in the housing and extends through an opening in the wall structure and into both the first and second chambers. Seal structure is disposed in the housing for restricting the movement of gases and liquids between the chambers through the opening in the wall structure other than by means of the wheel cavities. The invention further includes means operatively coupled to the wheel for rotating the wheel to transfer a gas from the second chamber into the first chamber, and to simultaneously transfer a liquid from the first chamber into the second chamber, by means of the wheel cavities.

The gas and liquid may be air and oil, respectively, and the oil may be disposed in both chambers, the liquid level in the first chamber being maintained at a desired level.

The invention may include a liquid pump to transport the liquid from the second or suction chamber into the first chamber, and may also include a liquid level sensing and flow regulating mechanism to maintain the liquid in the first or discharge chamber at a desired level.

Further, in order to additionally limit the amount of liquid that enters the cavities while in the first or discharge chamber and thereby reduce the required torque for turning the wheel and improve efficiency, structures such as (1) a weir controlled level, (2) a sloping membrane, (3) inclined cavities, and (4) a liquid path tangent to the wheel circumference, may be incorporated in and be a part of the invention.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

DESCRIPTION OF THE PREFERRED EMBODIMENT

A substantial efficiency increase has been obtained in a gas compressor device by using cavities in a rotating wheel to transfer a gas into a chamber of elevated pressure while simultaneously using the cavities to transfer a liquid out of this chamber.

Figure 1:
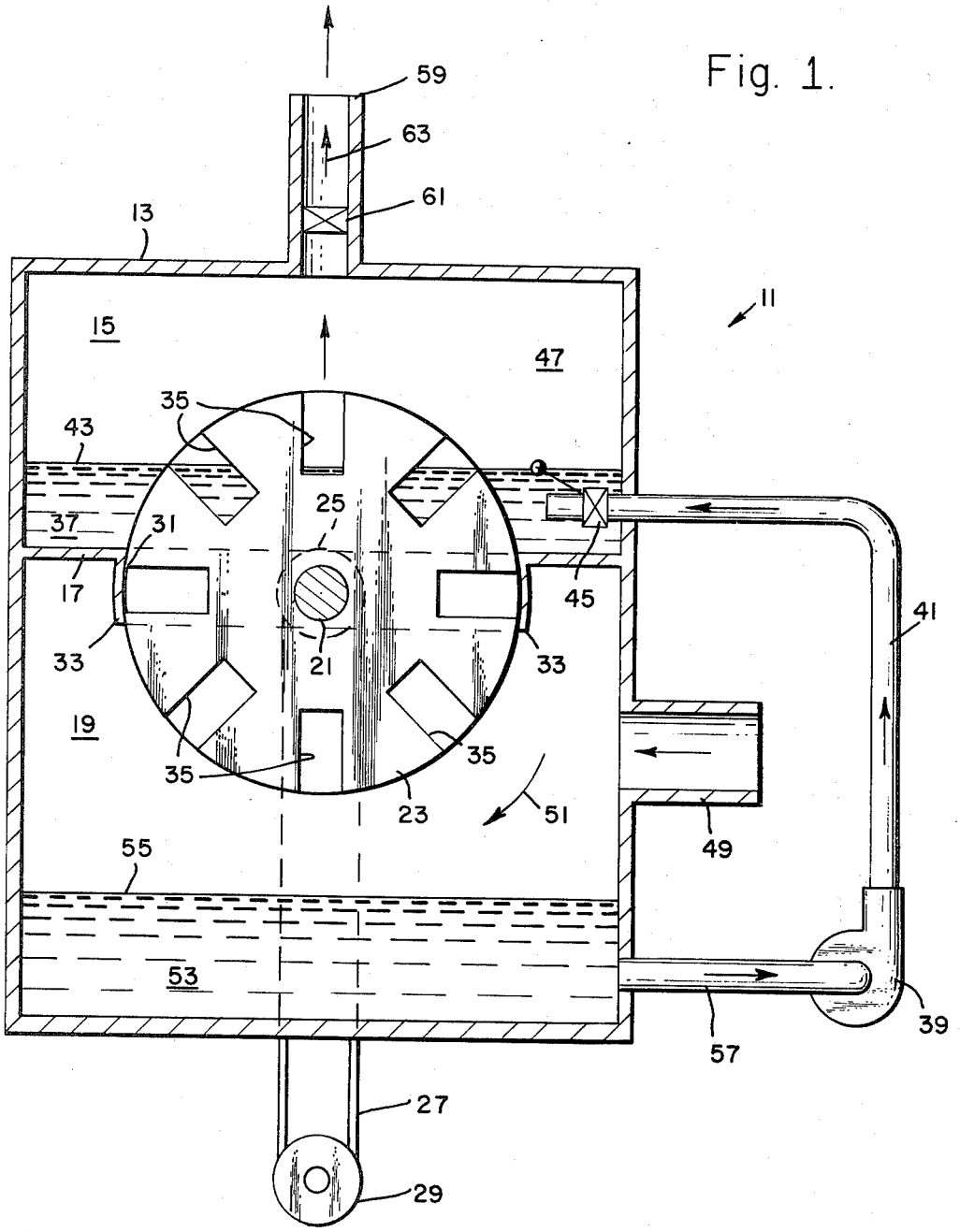
FIG. 1 is a partially schematic and cross sectional view of a gas compressor constructed in accordance with an embodiment of the present invention.

Referring now to FIG. 1, there is shown a gas compressor 11 with a housing 13 having a first chamber 15, a chamber separation plate 17, and a second chamber 19 below the first chamber. For reasons which will become evident, the first chamber 15 is designated a discharge chamber, and the second chamber 19 is referred to as the suction chamber. Mounted on a rotatable axle 21 is a transfer wheel 23 and a drive pulley represented by a dashed line 25. The drive pulley is coupled by a belt or chain 27 to a pulley/motor combination 29 which provides the power necessary to turn the transfer wheel 23. Of course, a gear drive or direct motor drive may be alternately utilized to rotate the transfer wheel.

The wheel axle 21, in this embodiment, is located just below the chamber separation plate 17, and the transfer wheel 23 extends into the upper chamber 15 through an appropriate wheel-accepting aperture 31. This aperture provides a close fit for the wheel 23, and in conjunction with conventional seal means such as seals 33, essentially no liquid or gas may move from one of the compartments to the other, except by means of cavities 35 disposed symmetrically about the periphery of the wheel 23. The wheel may be fabricated from any material generally considered suitable for the purpose intended, such a steel, an aluminum alloy or brass, for example, and the cavities may be provided by machining and the like within the wheel or by providing notches in the periphery of the wheel and attaching side plates to define the cavities, for example. The latter construction is illustrated in the drawings, but only the rear plate is shown, for clarity.

A liquid such as oil 37 is introduced into the upper or discharge chamber 15 by conventional means such as a liquid pump 39 and associated discharge piping 41, and the liquid is maintained at a desired level 43 by such means as a level-sensing float valve mechanism 45 or other suitable arrangement.

In operation, a gas such as air 47 to be compressed is allowed to enter the lower or suction chamber 19 by an inlet port 49. As the transfer wheel 23 is rotated in the direction indicated by arrow 51, gas is trapped in each cavity as it passes the seal 33, so as the wheel continues to be rotated, the gas is released in the discharge chamber 15. At the same time, the oil 37 in the upper chamber is trapped in an opposite cavity and released in the lower chamber 19 where it contributes to a reservoir 53 of the liquid having a level 55. This reservoir supplies the liquid, such as oil, to the pump 39 via the pump suction pipe 57.

As the wheel continues to be rotated, the gas in the suction chamber is trapped in successive wheel cavities and released in the discharge chamber, while, simultaneously, the liquid from this chamber is transferred by the cavities into the suction chamber. With the exposing of each successive cavity 35 into the upper chamber, gas pressure is increased and may be released at a desired pressure value by means of a gas discharge pipe 59 having a suitable valve 61, as indicated by arrow 63.

Figure 2:
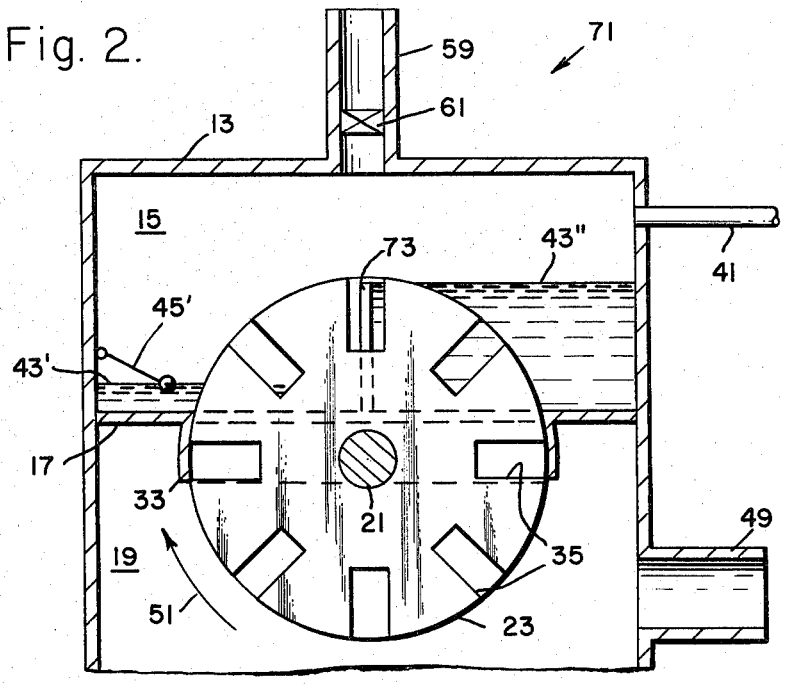
FIG. 2 illustrates still another embodiment of the present invention which utilizes a weir structure in the pressurized chamber.

In order to reduce the torque necessary to turn the wheel 23, the invention contemplates the use of structure which, for example, reduces the amount of the liquid 37 carried by the cavities 35 before these wheel cavities reach their uppermost position. This technique is illustrated by the weir controlled level embodiment 71 of FIG. 2, where a vertical weir 73 is provided in the discharge chamber 15.

As can be seen in this figure, the liquid level 43' in that portion of the upper chamber into which the gas-filled cavities first appear as the wheel 23 rotates in the direction indicated by the arrow 51 is lower than the level 43'' to the right side of the weir. With less liquid entering the cavities as they are introduced in the discharge chamber 15, less work is required to turn the wheel 23 since less liquid is raised from a lower level to a higher level.

The weir 73 is of course disposed on both sides of the wheel 23 in the upper chamber, and, although not shown, the float mechanism 45' is attached to a conventional valve mechanism to control the lower liquid level 43'.

Figure 3:
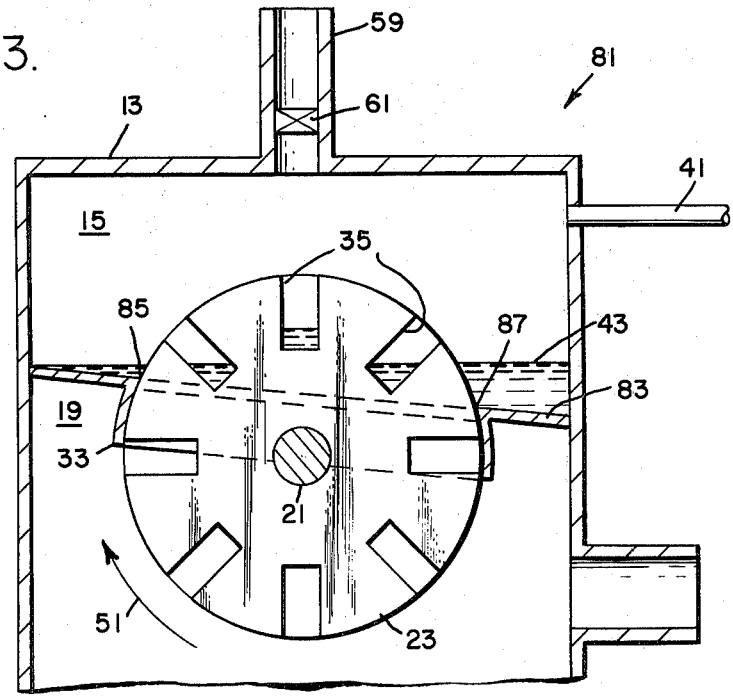
FIG. 3 is a partial schematic illustration of an embodiment of the invention incorporating a sloping membrane separating the two chambers of the compressor structure.

The theme of reducing the amount of liquid (in the upper chamber) that must be lifted in the wheel cavities as the wheel is turned may also be carried out as shown in the sloping membrane embodiment 81 illustrated in FIG. 3. Here, the horizontal chamber separation plate utilized in the previously described embodiments of the invention is replaced by a sloping membrane 83. It can be seen from this figure that the liquid level in the upper chamber 15 is much less at the point 85 where the cavities 35 enter this chamber than at the point 87 where the cavities leave the chamber.

Figure 4:
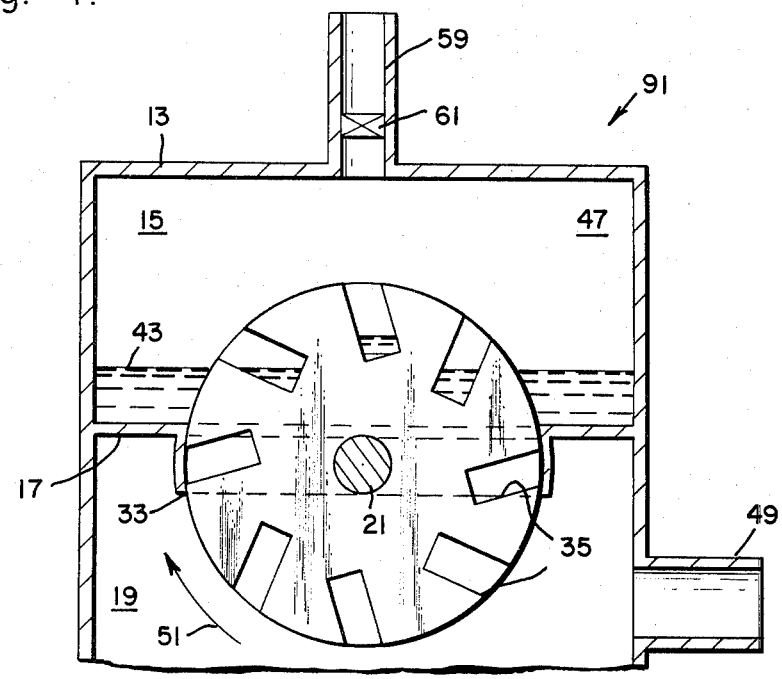
FIG. 4 illustrates an inclined cavity embodiment of the present invention.

Referring now to an inclined cavity embodiment 91 of the invention shown in FIG. 4, the cavities 35' are inclined at an angle which inhibits the filling of these cavities to their capacity, at least until they reach the apex of their travel. Of course, in this embodiment and in the embodiments of FIGS. 3 and 5, it is contemplated that the liquid level in the upper chamber is below the cavities at the uppermost portion of the wheel 23.

Figure 5:
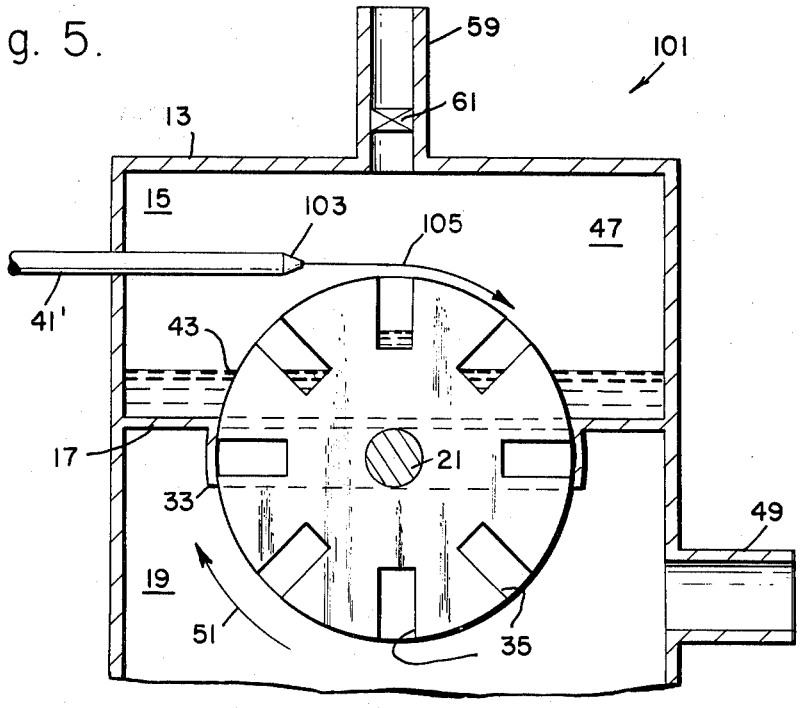
FIG. 5 is a partial schematic illustration of yet another embodiment of the invention wherein a liquid inlet flow is directed tangentially with respect to the circumference of the cavity wheel.

FIG. 5 illustrates yet a further torque-reducing embodiment of the invention. There is here shown an embodiment 101 wherein the liquid pump discharge pipe 41' includes a nozzle 103 which directs a liquid flow along a path 105 that is tangential to the wheel circumference 107. The flow of liquid will assist rotation of the wheel by fluid friction, and contact of the liquid on the wheel will assist the filling of the cavities.

From the foregoing, it should be evident that there has herein been described a unique and advantageous gas compressor which utilizes the technique of transferring a gas into a chamber of elevated pressure while simultaneously transferring a liquid out of that chamber.

It should also be understood that the materials and techniques used to fabricate the various embodiments of the invention are not critical, and that any material and technique generally found suitable in the art may be utilized.

Further, it should be recognized that although a limited number of embodiments of the invention have been described in detail, nevertheless, various changes and modifications which are obvious to persons skilled in the art to which the invention pertains are deemed to lie within the spirit, scope and contemplation of the invention.

I claim:

1. A gas compressor, comprising:

a housing having first and second chambers separated by a wall structure;

a wheel rotatably mounted in said housing and extending through an opening in said wall structure and into both said first and second chambers, said wheel including cavities therein;

seal means disposed in said housing including a liquid disposed in said first chamber and seal structure associated with said opening in said wall structure for restricting the movement of gases and liquids between said chambers through said opening in said wall structure other than by means of said cavities; and rotation means operatively coupled to said wheel for rotating said wheel to transfer a gas at a relatively lower gas pressure from said second chamber into said first chamber having a relatively higher gas pressure and to simultaneously transfer a liquid from said first chamber into said second chamber, by means of said cavities.

2. The gas compressor according to claim 1, wherein the level of said liquid in said first chamber is such to at least expose a portion of at least one of said cavities to said gas.

3. The gas compressor according to claim 1, wherein said first chamber is disposed above said second chamber.

4. The gas compressor according to claim 1, further comprising pump means for transporting a portion of said liquid from said second chamber into said first chamber.

5. The gas compressor according to claim 4, still further comprising sensing means disposed in said first chamber and operatively coupled to said pump means for sensing the level of said liquid in said first chamber and actuating said pump means to maintain said liquid in said first chamber at a desired level.

6. The gas compressor according to claim 1, wherein said gas is air.

7. The gas compressor according to claim 1, wherein said liquid is oil.

8. The gas compressor according to claim 1, also comprising gas inlet means disposed in said second chamber for introducing a gas to be compressed into said second chamber, and gas outlet means disposed in said first chamber for exhausting compressed gas from said first chamber.

9. A gas compressor, comprising:

a housing having an upper chamber and a lower chamber separated by a common wall, said wall including a wheel-accepting aperture therein, said upper chamber including a compressed gas discharge port, said lower chamber including a gas inlet port;

a liquid disposed in and partially filling said upper chamber, the remainder of said chamber being filled by said gas;

a wheel rotatably mounted in said housing and extending into both said chambers through said wheel-accepting aperture, said wheel including a plurality of symmetrically disposed cavities in the periphery thereof, each of said cavities being exposed to said gas in said upper chamber at some time during each revolution of said wheel;

rotation means operatively coupled to said wheel for rotating said wheel;

seal means disposed in said housing for restricting the movement of said liquid from said upper chamber to said lower chamber except in said cavities; and liquid transport means in said housing for maintaining said liquid in said upper chamber at a desired level.

10. The gas compressor according to claim 9, wherein said liquid transport means includes a liquid level sensing and flow-control mechanism disposed in said upper chamber.

11. The gas compressor according to claim 10, wherein said liquid transport means also includes a liquid pump operatively coupled to said lower chamber and to said liquid level sensing and flow-control mechanism for transporting said liquid in said lower chamber to said upper chamber as controlled by said liquid level sensing and flow-control mechanism.

12. The gas compressor according to claim 9, wherein the liquid is oil.

13. The gas compressor according to claim 9, wherein said gas is air.

14. The gas compressor according to claim 9, also comprising torque reducing means associated with said cavities and said liquid in said upper chamber for reducing the torque required by said rotation means to rotate said wheel.

15. The gas compressor according to claim 14, wherein said torque reducing means includes a weir disposed in said upper chamber and extending upwardly from said common wall on both sides of said wheel-accepting aperture.

16. The gas compressor according to claim 14, wherein said torque reducing means includes a sloping membrane whereby liquid in said upper chamber has a greater height where said cavities in said wheel leave said upper chamber than where said cavities leave said upper chamber.

17. The gas compressor according to claim 14, wherein said torque reducing means includes said cavities in said wheel with longitudinal axes inclined oppositely the direction of rotation of said wheel.

18. The gas compressor according to claim 14, wherein said torque reducing means includes a liquid inlet pipe extending into said upper chamber and having a nozzle directing a stream of said liquid tengential to the circumferential extremity of said wheel and in the direction of the rotation of said wheel.

* * * * *